US009217272B2

(12) United States Patent
Phillips

(10) Patent No.: US 9,217,272 B2
(45) Date of Patent: Dec. 22, 2015

(54) AUTOMATIC DOOR WITH EMERGENCY RESCUE SYSTEM

(71) Applicant: Complete Entry Systems and Services (2004) Inc., Ottawa (CA)

(72) Inventor: Parrish Phillips, Metcalfe (CA)

(73) Assignee: Complete Entry Systems and Services (2004) Inc., Ottawa (CA)

( * ) Notice: Subject to any disclaimer, the term of this patent is extended or adjusted under 35 U.S.C. 154(b) by 0 days.

(21) Appl. No.: 14/539,022

(22) Filed: Nov. 12, 2014

(65) Prior Publication Data

US 2015/0128496 A1 May 14, 2015

Related U.S. Application Data

(60) Provisional application No. 61/903,008, filed on Nov. 12, 2013.

(51) Int. Cl.

| | |
|---|---|
| ***E05B 65/10*** | (2006.01) |
| ***E05F 15/72*** | (2015.01) |
| ***E05F 15/611*** | (2015.01) |
| ***E05F 15/70*** | (2015.01) |
| ***E05F 15/77*** | (2015.01) |
| ***E05F 15/40*** | (2015.01) |
| ***E05B 65/06*** | (2006.01) |
| ***E05D 15/54*** | (2006.01) |

(Continued)

(52) U.S. Cl.

CPC ..... *E05F 15/72* (2015.01); *E05B 65/06* (2013.01); *E05B 65/10* (2013.01); *E05B 65/108* (2013.01); *E05D 15/54* (2013.01); *E05F 15/40* (2015.01); *E05F 15/611* (2015.01); *E05F 15/70* (2015.01); *E05F 15/73* (2015.01); *E05F 15/77* (2015.01); *E05D 2015/482* (2013.01); *E05Y 2900/112* (2013.01)

(58) Field of Classification Search

CPC ..... E05F 15/72; E05F 15/40; E05F 15/611; E05F 15/77; E05F 15/70; E05B 65/06; E05B 65/108; E05B 65/10

USPC ..... 49/141, 325, 326

See application file for complete search history.

(56) References Cited

U.S. PATENT DOCUMENTS

| | | | | |
|---|---|---|---|---|
| 5,429,399 | A * | 7/1995 | Geringer et al. | 292/92 |
| 6,581,423 | B2 | 6/2003 | Lin | 70/107 |

(Continued)

FOREIGN PATENT DOCUMENTS

| | | | | |
|---|---|---|---|---|
| DE | 19531323 | A1 * | 4/1996 | E05B 47/00 |
| DE | 10237729 | A1 * | 2/2004 | E05B 47/06 |

(Continued)

*Primary Examiner* — Jerry Redman

(74) *Attorney, Agent, or Firm* — Teitelbaum & MacLean; Neil Teitelbaum; Doug MacLean

(57) ABSTRACT

Automatic doors have become commonplace in hospitals or retirement homes to facilitate entry into auxiliary rooms, such as bathrooms. Unfortunately, when a patient becomes incapacitated inside the bathroom, the door often becomes obstructed by the patient, making entry into the bathroom through the door impossible without further injuring the patient. In many instances removal of adjacent walls is required to gain entry into the room. The automatic door of the present invention includes a retractable door stop enabling reverse rotation of the door, and sensors for automatically setting and resetting the automatic door controls when the door is opened and closed in either direction.

10 Claims, 6 Drawing Sheets

(51) Int. Cl.
*E05F 15/73* (2015.01)
*E05D 15/48* (2006.01)

(56) References Cited

U.S. PATENT DOCUMENTS

| | | | | |
|---|---|---|---|---|
| 6,793,254 | B1 | 9/2004 | Galvin | 292/163 |
| 8,019,476 | B2 * | 9/2011 | Kondo | 700/275 |
| 8,167,020 | B2 * | 5/2012 | Shanahan et al. | 160/266 |
| 8,186,729 | B2 | 5/2012 | Dudley | 292/201 |
| 2004/0098915 | A1 * | 5/2004 | Baldry | 49/339 |
| 2008/0250716 | A1 * | 10/2008 | Ranaudo et al. | 49/31 |
| 2012/0204490 | A1 * | 8/2012 | Lanigan et al. | 49/30 |
| 2012/0227324 | A1 * | 9/2012 | Kristerson | 49/141 |

FOREIGN PATENT DOCUMENTS

| | | | | |
|---|---|---|---|---|
| EP | 2400104 | A2 * | 12/2011 | |
| JP | 04279177 | A * | 10/1992 | A62C 2/06 |

* cited by examiner

AUTOMATIC DOOR WITH EMERGENCY RESCUE SYSTEM

CROSS-REFERENCE TO RELATED APPLICATIONS

The present invention claims priority from U.S. Patent Application No. 61/903,008 filed, Nov. 12, 2013, which is incorporated herein by reference.

TECHNICAL FIELD

The present invention relates to an automatic door, and in particular to an automatic door with an emergency rescue system.

BACKGROUND OF THE INVENTION

Conventional automatic doors include a door opening mechanism activated by the push of a button. Automatic doors are often used in hospitals and retirement homes to facilitate entry into private rooms, e.g. bathrooms. Unfortunately, in emergency situations in which the door becomes locked or obstructed, e.g. by a fallen patient, there is no way to enter the room without further injuring the patient except by the removal of adjacent walls.

An object of the present invention is to overcome the shortcomings of the prior art by providing an automatic door with an emergency rescue system.

SUMMARY OF THE INVENTION

Accordingly, the present invention relates to an automatic door system for mounting in an opening to a room comprising:

a door mounted in a frame in the opening, pivotable in a first direction from a closed position into the room to an open position during normal operation;

an automatic door opening device for rotating the door into the open position in response to a first signal;

a lockset in the door including:

a retractable latch for engaging the frame, a latch control for retracting the latch in response to a first signal, first and second rotatable manual actuators for manually retracting the latch enabling the door to be opened manually from inside or outside the room, respectively, and a manual actuator lock for preventing the second rotatable manual actuator from being rotated from outside the room in response to a second signal;

a first switch for mounting outside the room for activating the first signal for actuating the latch control to retract the latch, and for activating the automatic door opening device to open the door;

a second switch for mounting inside the room for activating the first signal to actuate the latch control to retract the latch, and for activating the automatic door opening device to open the door, respectively;

a door locking switch for mounting inside the room for deactivating the first switch preventing the automatic door opening device from being activated, and for activating the second signal to actuate the manual actuator lock to prevent the second manual actuator from being rotated from outside the room;

a retractable door stop moveable from an extended position to a refracted position for preventing the door from pivoting in a direction opposite the first direction out of the room when in the extended position, and for enabling the door to open in the opposite direction out of the room when in the retracted position;

a first sensor for re-activating the first switch and for deactivating the manual actuator lock, when the door is opened from the inside from the closed position; and a second sensor for determining when the door has been rotated in the opposite direction outside of the room for deactivating the first and second switches to prevent them from activating the automatic door opening device.

BRIEF DESCRIPTION OF THE DRAWINGS

The invention will be described in greater detail with reference to the accompanying drawings which represent preferred embodiments thereof, wherein.

DETAILED DESCRIPTION

While the present teachings are described in conjunction with various embodiments and examples, it is not intended that the present teachings be limited to such embodiments. On the contrary, the present teachings encompass various alternatives and equivalents, as will be appreciated by those of skill in the art.

Figure 1:
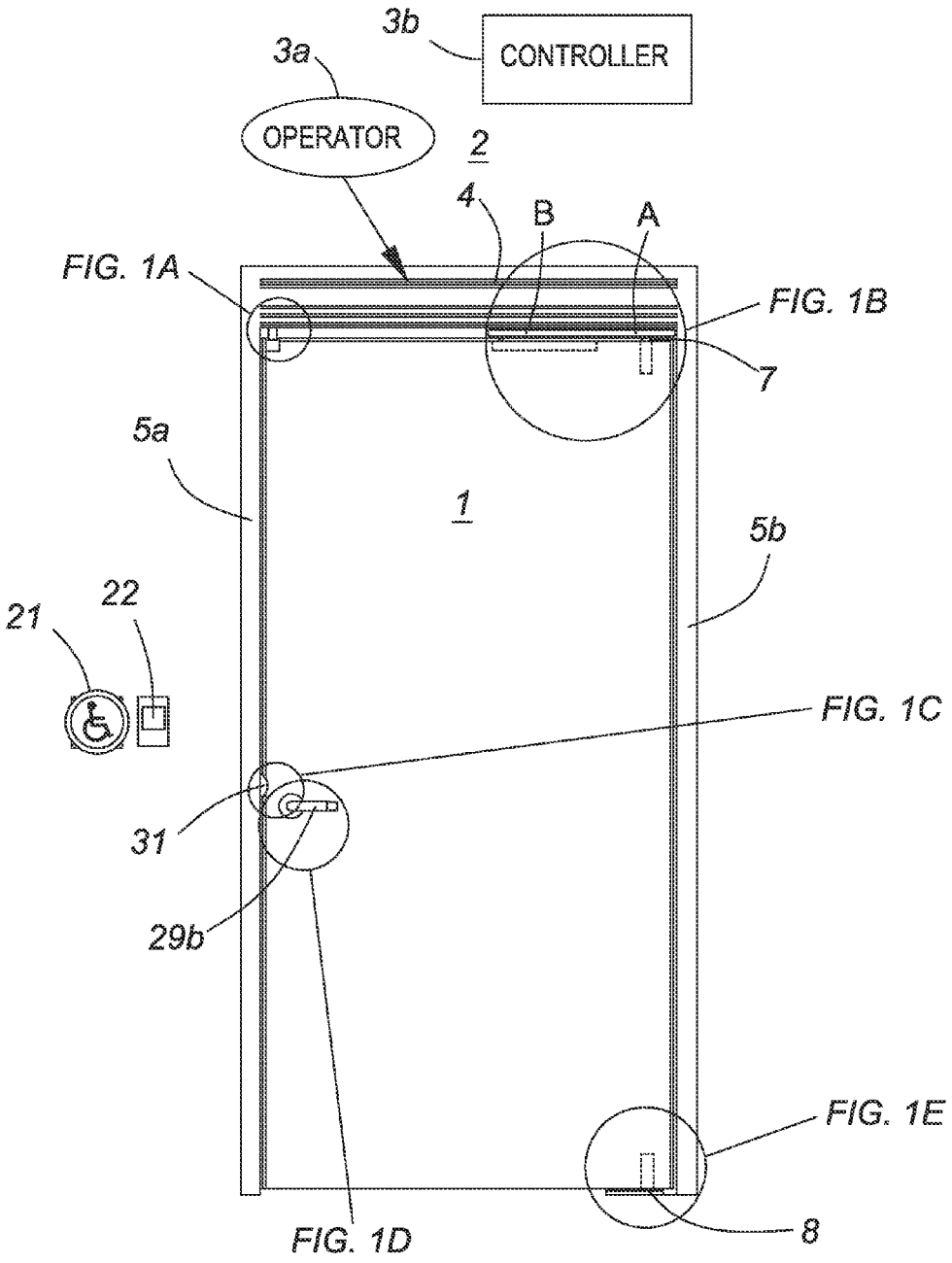
FIG. 1 is an exterior view of the emergency door of the present invention.
Figure 1A:
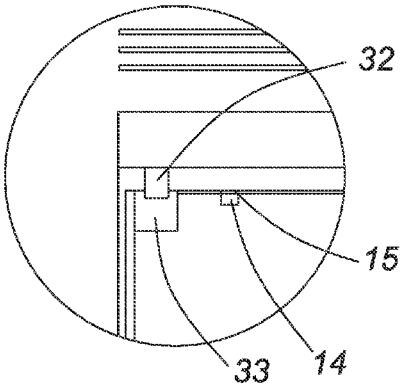
FIG. 1A is a magnified view of the upper corner of the unhinged side of the door of FIG. 1.
Figure 1B:
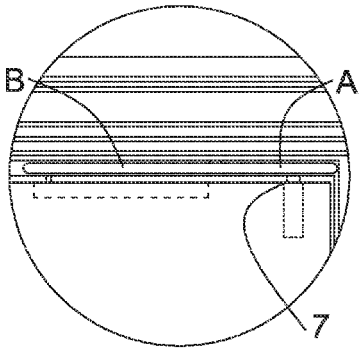
FIG. 1B is a magnified view of the upper corner of the hinged side of the door of FIG. 1.
Figure 1C:
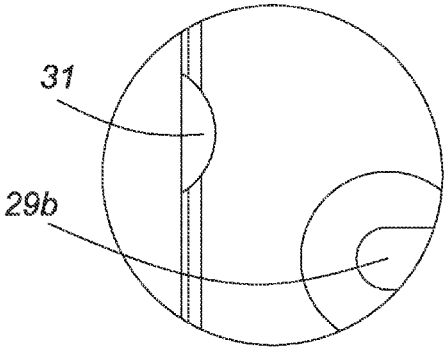
FIG. 1C is a magnified view of a retractable door stop of the door of FIG. 1.
Figure 1D:
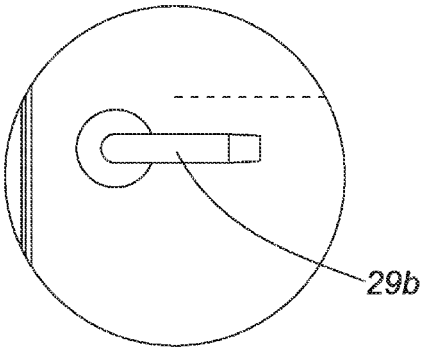
FIG. 1D is a magnified view of a door handle of FIG. 1.
Figure 1E:
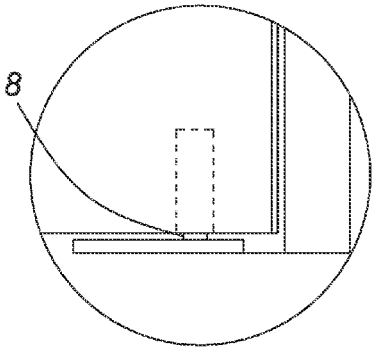
FIG. 1E is a magnified view of the lower corner of the hinged side of the door of FIG. 1.

With reference to FIG. 1, the door system, in accordance with an embodiment of the present invention, comprises a power assisted automatic door 1, ideally with privacy locking abilities. Typically, the door 1 swings into a smaller auxiliary room, e.g. washroom, for general use, and has the ability to be pulled outward into a main room or hallway in an emergency. Accordingly, the door 1 will have the capability to rotate a complete 180.

The automatic door opening device 2 may be any suitable door opening device, including a mechanical operator 3*a* and an electrical/computer controller 3*b*, but is ideally a Gyro Tech 8350™ heavy duty series with reduced opening force, preset at the manufacturer. The mechanical operator 3*a* is partially mounted in a header box 4, which is preferably center positioned aluminum with a front access panel above the door 1. The mechanical operator 3*a* includes a pivot assemble A and an arm assembly B that slides and pivots along a track 9 at the top of the door 1. The electrical/computer controller 3*b* may be mounted in the header box 4 or in a remote location, depending on space availability. Jamb tubes 5*a* and 5*b* are preferably one piece 2"×5" extruded aluminum with factory preparation for the center positioned header box 4 forming a door frame, but any suitable size and material are possible.

The door 1 may be made of any suitable material, but is preferably a solid wood core PLAM (plastic laminated) door with a standard finish. The illustrated embodiment is factory prepared for center hung pivots, i.e. top and bottom pivots 7 and 8, respectively, that match the pivots and tracks of the door 1 and the door opening device 2, for pivotally mounting the door 1 in the door frame, but any suitable arrangement is within the scope of the invention. The door 1 may include a lockset 6, e.g. a mortise lockset, with a power transfer core 11, horizontally concealed within a power transfer conduit 12 extending across the center of the door 1 to a pre-determined position at the inner edge of the door 1. The power transfer core 11 is electrically connected to the controller 3*b* and a power supply via a wire transfer loop 13, which extends from the end of the power transfer conduit 12 to a suitable conductor in the jamb tube 5*a*.

The system is preferably powered with a dedicated 15A circuit for both a Von Duprin Power supply and the automatic door opening device 2. The power supply typically includes a 4A double output, capable of a 14A in-rush. The 4A Von Duprin 914 2RS power supply is typically mounted in the ceiling in close proximity to the door 1, and electrically connected to the computer controller 3*b* and the mechanical operator 3*a*.

The power supply also supplies power to both solenoids 41 and 42 in the lockset 6. The circuit dedicated to the automatic door system 2 powers a 24V step-down transformer. The transformer supplies power for all low voltage devices that surround the system, including: two switching network relay boards, the first and second push buttons 21 and 23, the occupied indicator 22, the third push button 24, and an AC/DC voltage rectifier.

The two switching network relay boards may provide relay logic control with time delay for prolonged activation, delay on relay activation and sequencing activation. The timing may be adjustable by potentiometers.

A core hole 14 is provided in a top channel of the door 1, near the nose of the door 1, for receiving a contact sensor 15, e.g. magnetic. A corresponding sensor in the header box 4 sends a signal to the controller 3*b* when the contact sensor 15 is in position, i.e. when the door 1 is in the closed position.

A first push button 21 is provided on an exterior wall adjacent to the door jamb 5*a*, connected to the door opening device 2 for activating the mechanical operator 3*a* to open the door 1. Preferably, a room occupied indicator 22, e.g. light, sign or other visual indicator, is provided adjacent the push button 21 to provide an indication that the auxiliary room is occupied and/or in use.

Typically, interior and exterior rotating door handles 29*a* and 29*b* are also provided on the interior and exterior of the door 1, respectively, to manually disengage a door latch 28 from the door frame, as is well known in the art. The door handles 29*a* and 29*b* can be any suitable manually actuator, e.g. knob, lever etc.

Figure 2:
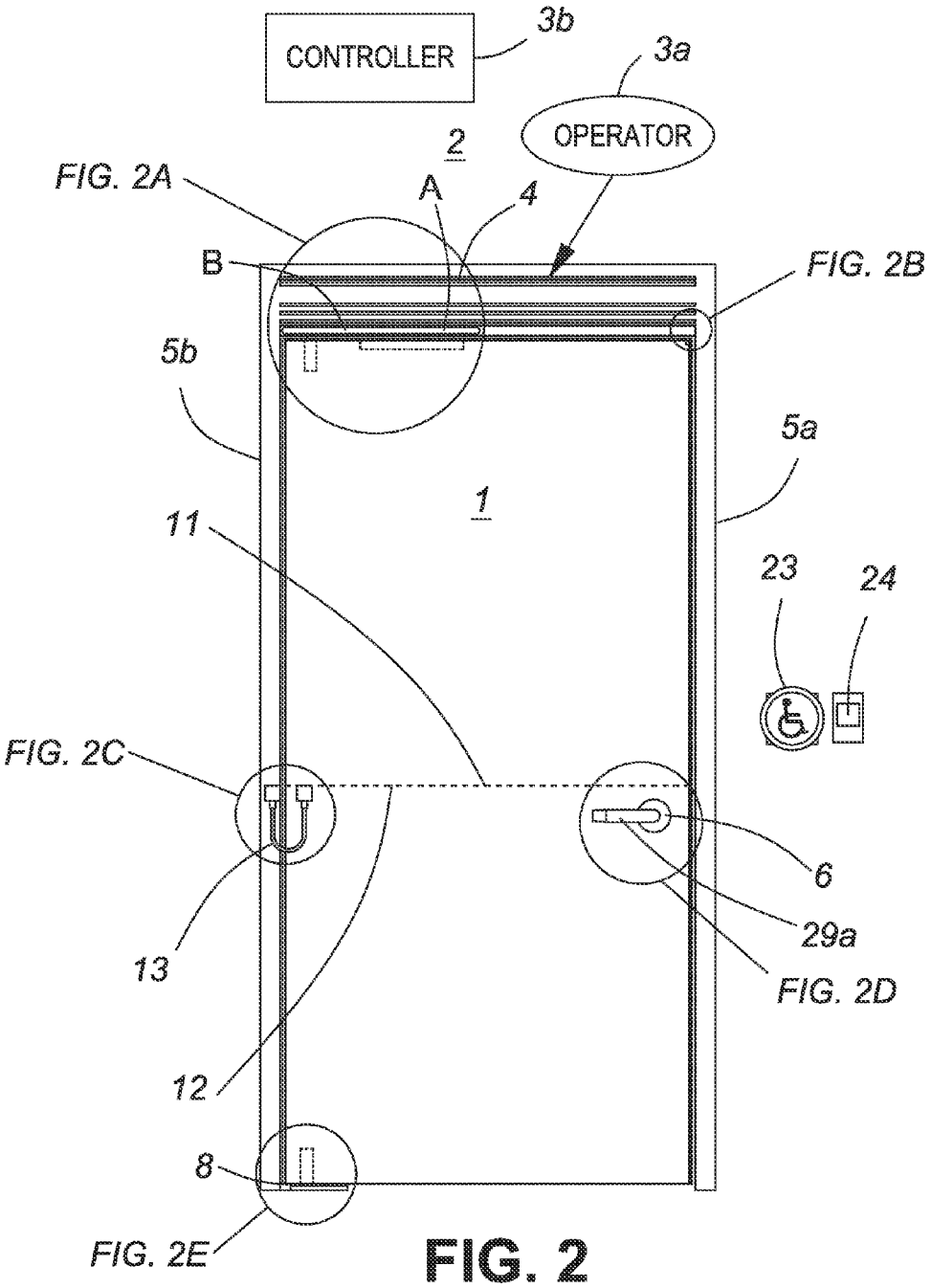
FIG. 2 is an interior view of the emergency door of FIG. 1.
Figure 2A:
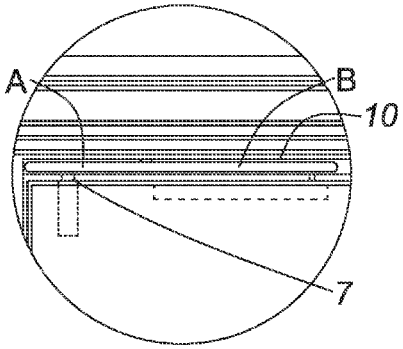
FIG. 2A is a magnified view of the upper corner of the hinged side of the door of FIG. 2.
Figure 2B:
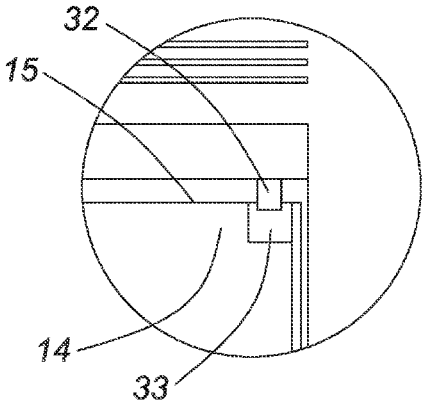
FIG. 2B is a magnified view of the upper corner of the unhinged side of the door of FIG. 2.
Figure 2C:
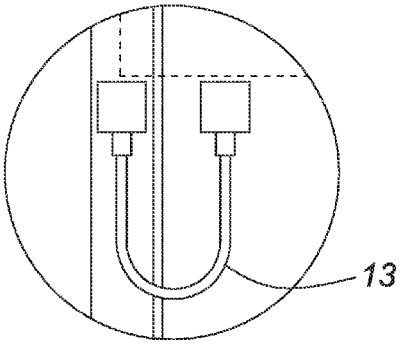
FIG. 2C is a magnified view of a wire transfer loop of the door of FIG. 2.
Figure 2D:
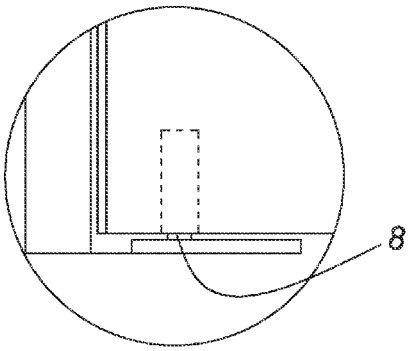
FIG. 2D is a magnified view of the lower corner of the hinged side of the door of FIG. 2.
Figure 2E:
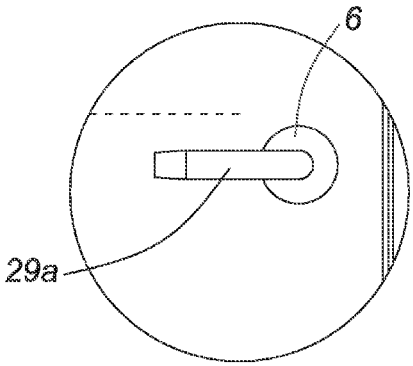
FIG. 2E is a magnified view of a door handle of FIG. 2.
Figure 3:
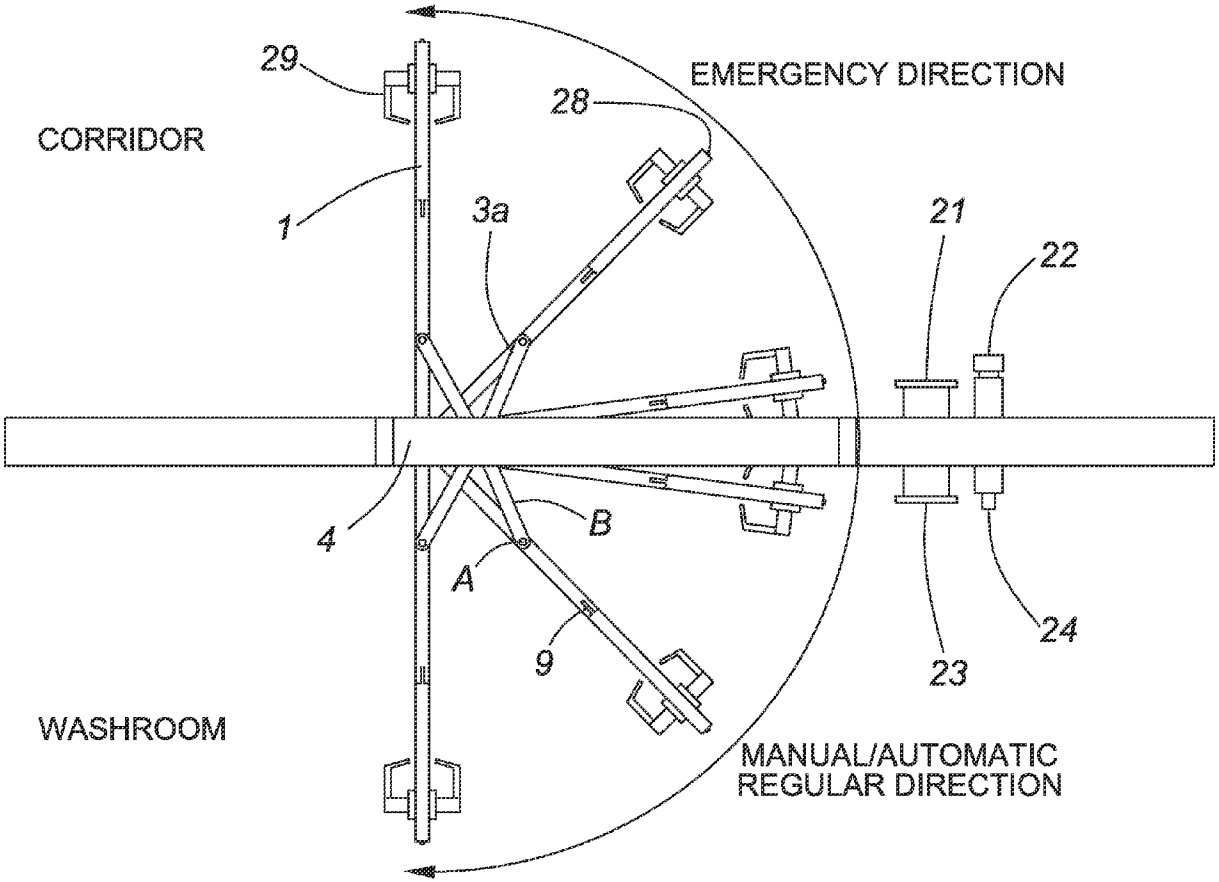
FIG. 3 is a top view of the emergency door of FIGS. 1 and 2.

With reference to FIG. 2, a second push button 23 is also provided on an interior wall of the auxiliary room adjacent the door jamb 5*a*, connected, e.g. electrically or wirelessly, to the door opening device 2 for activating the mechanical operator 3*a* to open the door 1. A third push button 24 also may be provided on the interior wall of the auxiliary room adjacent the door jamb 5*a*, connected to the lockset 6 via the controller 3*b* and the power transfer core 11, for locking, e.g. electrically or magnetically, the lockset 6, and therefore the door 1, in the closed position. Ideally, the third push button 24 sends a signal to the controller 3*b* to send a signal to the lockset 6 to lock the exterior door handle 29*b* from rotation, i.e. withdrawal of the latch 28, thereby preventing entry from the exterior of the auxiliary room. Rotation of the interior door handle 29*a* is still possible after the third push button 24 is pushed for withdrawing the latch 28 and opening the door 1 from the inside only. Activation of the third push button 24 may also result in the controller 3*b* activating the room occupied indicator 22 on the exterior wall (see above). The third push button 24 may include a visible or audible indicator activated when the third push button is activated with the door latch 28 engaged in the door jam 5*a*, thereby indicating the room is occupied and the door 1 is locked.

Figure 4:
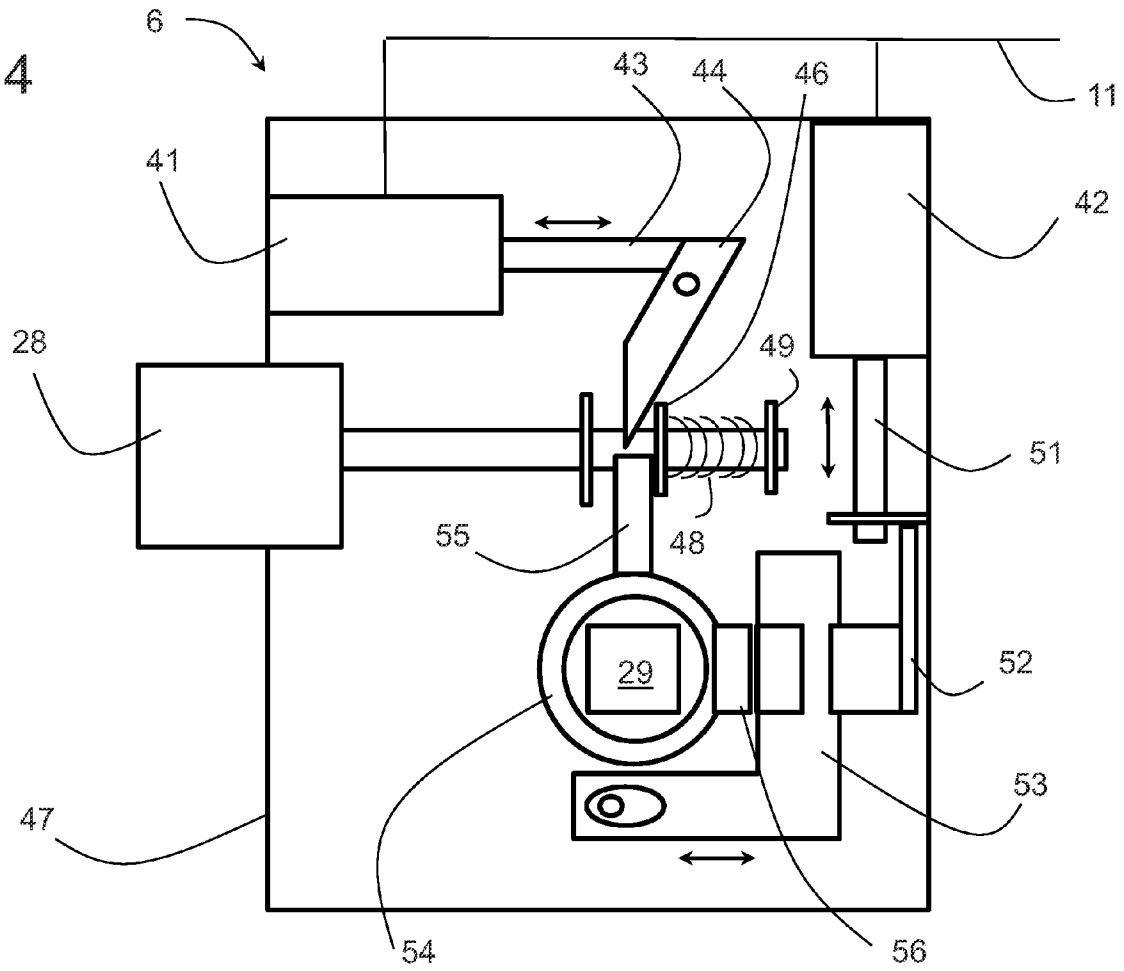
FIG. 4 is a top view of an embodiment of a lockset of the emergency door or FIGS. 1 to 3.

With reference to FIG. 4, an exemplary embodiment of the lockset 6 includes two solenoids, a first solenoid 41 controlled by the controller 3*b* via power transfer core 11 for retracting the latch 28, when the first push button 21 is pushed, and a second solenoid 42 for preventing the exterior door handle 29*b* from being rotated, thereby preventing the latch 28 from being manually retracted and preventing the door from being opened manually from the outside, when the third push button is pushed. Only the exterior door handle 29*b* is prevented from being rotated, the interior handle 29*a* can still be rotated, as hereinafter described. Alternative locksets and locking mechanisms are also within the scope of the invention.

The first solenoid 41 includes a first piston 43, actuation of which rotates a first arm 44, the outer free end of which engages a collar 46 mounted on the latch 28 for retracting the latch 28 back into a lockset housing 47. The latch 28 is spring biased outwardly, e.g. by a coil spring 48 extending between the collar 46 and a guide sleeve 49 fixed in the housing 47.

The second solenoid 42 includes a second piston 51, actuation of which moves a second arm 52, which reciprocates a lock 53 for engaging a door handle mechanism 54. Typically, rotation of the door handle mechanism 54 by the door handle 29*a* or 29*b* results in a finger 55, extending from the door handle mechanism 54, to engage the collar 46 and retract the latch 28. However, actuation of the second solenoid 42 causes the lock 53 to reciprocate or pivot into engagement with an abutting feature 56 extending from the door handle mechanism 54, thereby preventing the door handle mechanism 54 from rotating to retract the latch 28.

The present invention eliminates the need for an additional manual deadbolt latch, as the door latch 28 acts as both retractable spring latch and deadbolt. An additional deadbolt would provide an additional locking feature that could not be overcome in case of an emergency.

Instead of a conventional door stop extending the entire length of the jambs 5*a* and 5*b*, and header 4, the present invention includes only one or a plurality of retractable, e.g. rotating, door stops 31 extending from the door jamb 5*a* on the outside of room to prevent the door 1 from swinging back out, i.e. the opposite direction to the normal rotation into the room. The retractable door stops 31 extend from the vertical door jamb 5*a* into engagement with the outer surface of the unhinged side of the door 1. A single retractable door stop 31 at a convenient location on the door jamb 5*a* may be provided or a plurality of retractable door stops 31 spaced apart along the door jamb 5*a* may be provided. The retractable door stops 31 may be manually moveable out of position, e.g. rotated or slid into a recess in the door jamb 5*a*, in the event that a person is incapacitated or otherwise unable to open the locked door 1 from the inside. Spring loaded adjustable weather stripping or the like may be provided over the gap between the door 1 and the door jam 5*a* along the unhinged side of the door 1 for privacy in place of the conventional door stop.

A safety switch sensor 32, e.g. a toggle switch, is provided in a convenient location in the door frame to provide an indication to the controller 3*b* that the door 1 has been opened in the opposite direction to normal, and in particular for deactivating the lockset 6 to enable the door 1 to be reset to the unlocked position. The safety switch sensor 32 is ideally in the form of a toggle switch that abuts against the door 1 or a kick plate 33 at an upper corner of the unhinged side of the door 1.

The speed of the open, back check and latch 28 may be adjustable with potentiometers on a control board in the automatic door operator 2. The time delay of both, the automatic and power assist hold open at 90° for the mechanical operator 3*a* of the door 1 may be adjustable with potentiometers on the control board provided. The closing speed and breakout open speed of the mechanical operator 3*b* of the door 1 may be set at the manufacturer or after installation. The delay on activation between retraction of the automatic latch 28 and activation of the automatic door operator 2 may be adjustable on a switching network module. The setting of the power assist or fully manual open for the door 1 is set with a dip switch on the control board of the automatic door operator 2. Obstruction sensitivity on open of the door 1 is also adjustable with potentiometers on the control board.

Exemplary Method of Use

In an unused rest position, the door 1 is closed, the lockset latch 28 is engaged in a latch strike in door jamb 5*a*, and the door handles 29*a* and 29*b* are set in Passage function (unlocked both directions). The room occupied indicator 22 and the third push button 24 are not energized, e.g. illuminated.

When someone enters the auxiliary room, e.g. the washroom, they will either: (i) press the exterior first push button 21 to activate the automatic door system 2; or (ii) manually turn the exterior door handle 29*b* to push the door 1 into the room. By pressing the exterior first push button 21, a signal is sent to the controller 3*b*, which enables the power supply to energize the lockset 6 and automatically retract the latch 28. The latch 28 will stay refracted for a set time before releasing. Another signal is sent from the controller 3*b* to the automatic door operator, which then opens the door 1 to the 90° position and holds the door 1 open for a set time delay, e.g. 10 seconds, before closing.

In an alternative embodiment, turning the exterior door handle 29*b* and pushing the door 1, may signal the controller 3*b* to enable the door opening device 2 to provide a low energy power assist, which automatically assumes the opening of the door 1.

Once someone is in the washroom and the door 1 has closed and the latch 28 is engaged, the third push button 24 is pressed to send a signal to the controller 3*b* to activate the lockset 6 and the room occupied indicator 22. The controller 3*b* also sends a signal to illuminate the third push button 24, indicating that the door 1 is locked from the outside. Simultaneous with pressing the third push button 24, the controller 3*b* enables the power supply to energize the locking feature, e.g. the second solenoid, of the lockset 6. Accordingly, the lockset 6 is set into Storeroom function that locks the exterior side of the door handle 29*b* from being able to rotate and disengage the latch 28 from the door jam 5*a*, i.e. open the door 1. Moreover, the room occupied indicator 22 on the exterior side of the washroom will illuminate, and the exterior first push button 21 will be disabled.

When exiting the room, the occupant either: (i) presses the second (interior) push button 23 to generate a signal to the controller 3*b*, which activates the automatic door system 3; or (ii) manually turns the interior door handle 29*a* to pull the door 1 open. As soon as the door 1 becomes ajar, the concealed magnetic door contact 15 will break continuity, thereby sending a signal to the controller 3*b* to reset the system 2 to the original unused rest condition, i.e. deactivate the second solenoid 42 enabling the exterior handle 29*b* to open the door 1, and reactivate the exterior first push button 21 to enable the door 1 to be automatically or manually opened.

Emergency Function

When someone is locked in the room, needs assistance, and is unable to unlock the door 1 either manually or automatically, the door 1 of the present invention will be able to be opened manually from the exterior side. First, a rescuer on the outside will disengage, i.e. rotate or push, each of the door stops 31 into recesses provided in the jamb 5*a* until they are at least flush with the jam 5*a* and no longer abutting the door 1. The rescuer then can pull the door 1 in the opposite direction away from the auxiliary room and into the corridor or main room. The inclined outer edge of the latch 28 abuts the door jam 5*a*, i.e. the latch strike provided thereon, causing the latch 28 to retract into the lockset housing 47 without having to rotate the exterior handle 29*b*. Upon outward rotation, the door 1 will physically engage the rocker switch sensor 32, thereby sending a signal to the controller 3*b* and setting the system into the breakout mode. In the breakout mode, the door 1 may go into a power assisted safe mode, whereby the door operator 3*a* slowly opens the door 1 to a 90° position, or a manual safe mode, whereby the door 1 may be opened manually in the reverse direction. In either safe mode, the controller 3*b* deactivates the push button switches 21 and 23, so that the automatic door opening device 3*a* cannot be engaged while the door 1 is rotating or rotated in the opposite direction out of the room. All automatic functions are disabled by the controller 3*b* when the rocker switch sensor 32 is set in the breakout mode.

To reset the system, the door 1 is simply rotated back into the door frame, and the door stops 31 are moved back into position preventing the door 1 from rotating in reverse into the main room or corridor. The rocker switch sensor 32 can then be reset. Engagement of the magnetic contact switch sensor 15 will send signals to the controller 3*b*, which will transmit appropriate signals to reset the exterior door handle 29*b* to passage function, i.e. deactivating the first and second solenoids, releasing the latch 28 and unlocking the electronic locking feature on the exterior door handle 29*b*.

The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. An automatic door system for mounting in an opening to a room comprising:

a door mounted in a frame in the opening, pivotable in a first direction from a closed position into the room to an open position during normal operation;

an automatic door opening device for rotating the door into the open position in response to a first signal;

a lockset in the door including:

a retractable latch for engaging the frame, a latch control for retracting the latch in response to the first signal, first and second rotatable manual actuators for manually retracting the latch enabling the door to be opened manually from inside or outside the room, respectively, and a manual actuator lock for preventing the second rotatable manual actuator from being rotated from outside the room in response to a second signal;

a first switch for mounting outside the room for activating the first signal for actuating the latch control to retract the latch, and for activating the automatic door opening device to open the door;

a second switch for mounting inside the room for activating the first signal to actuate the latch control to retract the latch, and for activating the automatic door opening device to open the door, respectively;

a door locking switch for mounting inside the room for deactivating the first switch preventing the automatic door opening device from being activated, and for activating the second signal to actuate the manual actuator lock to prevent the second manual actuator from being rotated from outside the room;

a retractable door stop moveable from an extended position to a retracted position for preventing the door from pivoting in a direction opposite the first direction out of the room when in the extended position, and for enabling the door to open in the opposite direction out of the room when in the retracted position;

a first sensor for re-activating the first switch and for deactivating the manual actuator lock, when the door is opened from the inside from the closed position; and a second sensor for determining when the door has been rotated in the opposite direction outside of the room for deactivating the first and second switches to prevent them from activating the automatic door opening device.

2. The automatic door system according to claim 1, further comprising a controller electrically connected to the automatic door opening device, the first, second and door locking switches, the first and second sensors, the latch control, and the manual actuator lock;

wherein the controller receives signals from the first and second sensors, and the first, second and door locking switches, and sends the first and second signals to the automatic door opening device, the latch control, and the manual actuator lock, respectively.

3. The automatic door system according to claim 1, wherein the second sensor activates the automatic door opening device to automatically open the door in the opposite direction.

4. The automatic door system according to claim 1, wherein the second sensor comprises a toggle switch having an outer free end extending into close proximity to the door on the outside of the room.

5. The automatic door system according to claim 1, wherein the first sensor reactivates the first and second switches, and deactivates the manual actuator lock when the door is rotated back into the closed position from outside the room.

6. The automatic door system according to claim 1, wherein the first sensor comprises a magnetic contact switch with contacts in the door and in the door frame.

7. The automatic door system according to claim 1, wherein the retractable door stop comprises at least one rotating door stop pivotable from an extended position extending from the door frame on the outside of the room to a retracted position in a recess in the door frame.

8. The automatic door system according to claim 1, further comprising flexible weather stripping covering a vertical gap between the door and the door frame along an unhinged side of the door ensuring privacy.

9. The automatic door system according to claim 1, wherein the lockset includes a first solenoid for retracting the latch, and a second solenoid for positioning the manual actuator lock in contact with the second manual actuator.

10. The automatic door system according to claim 1, further comprising a light mounted outside the room, activatable by the door locking switch to signal that the room is occupied, and deactivatable by the second sensor when the door is opened.

* * * * *